United States Patent [19]

Chaffin

[11] 3,968,845

[45] July 13, 1976

[54] APPARATUS AND METHOD FOR GEOLOGICAL DRILLING AND CORING

[76] Inventor: John D. Chaffin, 851 Haverford Ave., Pacific Palisades, Calif. 90272

[22] Filed: Mar. 6, 1975

[21] Appl. No.: 555,784

Related U.S. Application Data

[60] Division of Ser. No. 323,852, Jan. 15, 1973, Pat. No. 3,887,020, which is a continuation-in-part of Ser. No. 132,001, April 7, 1971, abandoned.

[52] U.S. Cl. ..... 175/60; 175/72; 175/206; 175/212; 175/213; 175/217

[51] Int. Cl.[2] ..... E21B 49/00

[58] Field of Search ..... 175/60, 206, 207, 212, 175/213, 217, 218, 171

[56] References Cited

UNITED STATES PATENTS

| | | | |
|---|---|---|---|
| 682,939 | 9/1901 | Ivens | 175/213 |
| 2,167,393 | 7/1939 | Muney | 175/60 X |
| 2,329,330 | 9/1943 | Brailey | 175/213 X |
| 2,839,273 | 6/1958 | Holman et al. | 175/206 |
| 2,849,213 | 8/1958 | Failing | 175/215 X |
| 3,291,229 | 12/1966 | Houston | 175/60 |
| 3,655,001 | 4/1972 | Hoffman | 175/213 |

FOREIGN PATENTS OR APPLICATIONS

| | | | |
|---|---|---|---|
| 1,155,672 | 12/1957 | France | 175/60 |

*Primary Examiner*—Frank L. Abbott
*Assistant Examiner*—William F. Pate, III

[57] ABSTRACT

Apparatus and method for complete reverse air vacuum drilling by entrainment of chips and dust in a high velocity air stream created by applying a vacuum to the drill stem or the annulus of a drilled hole, removing the drilled particles by entrainment in the flow of air created by the vacuum and collection of the drilled particles for visual or other analysis.

4 Claims, 7 Drawing Figures

FROM COMPRESSER

APPARATUS AND METHOD FOR GEOLOGICAL DRILLING AND CORING

This application is a division of application Ser. No. 323,852, filed Jan. 15, 1973, now U.S. Pat. No. 3,887,020, which is a continuation-in-part of application Ser. No. 132,001, now abandoned, filed Apr. 7, 1971.

FIELD OF THE INVENTION

The field of the invention is the drilling and coring of geological structures and obtaining continuous and rapid delivery of strata material as it is being drilled.

DESCRIPTION OF PRIOR ART

Drilling apparatus and methods involving creating an airflow through the drill stem in a drilled hole for withdrawing the drilled particles upward from the bottom of the hole are known. For example, see U.S. Pat. No. 3,291,229, issued Dec. 13, 1966. However, collection of the sampled material, using the known systems, has been very costly and time-consuming with a relatively low degree of accuracy in obtaining a sample which is readily indicative of the subterranean formations. Furthermore, there is no known apparatus or method for switching from the dry method to other methods of drilling in a matter of seconds. Ordinarily, this operation would require lengthy delays while very complex machinery transfers could be undertaken.

OBJECTS OF THE INVENTION

It is a general object of the present invention to provide a new and novel machine a method for removing strata material from any geological surface and collecting it in an accurate, fast and easy manner without interrupting the drilling process.

It is a further object of the present invention to provide for drilling geological samples without polluting the atmosphere with dust particles.

It is another object to obtain 100% recovery of the sample material.

It is yet another object of this invention to provide a more rapid visual correlation between the sample taken and the depth at which the sample was extracted.

Still another object of this invention is a machine having a manifold means which allows switching from dry drilling when water or other unsatisfactory conditions are encountered, and switching back to dry drilling when the conditions have been overcome.

Another object of this invention is an apparatus and method which permits continuous drilling even through "thief" formations or old tunnels.

Other objects and advantages will become apparent from the following description and drawings.

Figures 1, 2, 7:
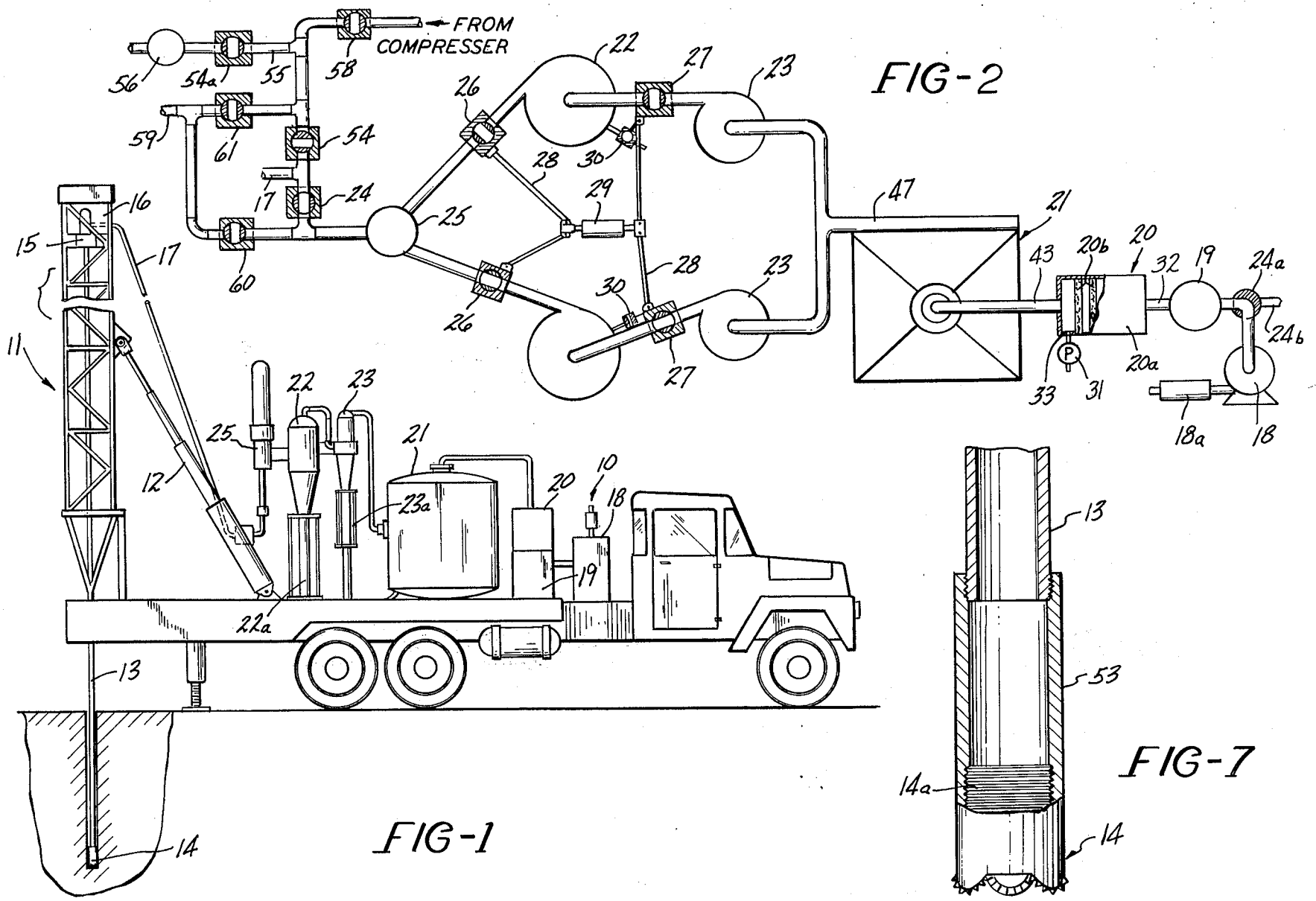
FIG. 1 is a schematic side elevation view of a preferred drilling apparatus according to the invention.
FIG. 2 is a functional schematic of the apparatus showing the relationships of the components.
FIG. 7 is a partly sectional view of a preferred drilling bit and connector assembly.

The method of drilling and recovery of geological material by the reverse air vacuum system reduces the amount of time and work required in taking geologic samples because a vacuum system, which results in air velocities upward through the drill stem of 5,000 to 15,000 fpm, is more efficient in lifting the particulate material to the surface than the old high pressure air or water methods. As a result, larger particles can be lifted with attendant reduction in costs associated with drilling to the smaller particle size required by high pressure systems. Also, high pressure systems are more dangerous to persons working around them, while the reverse air vacuum is positively dust free. Lastly, the reverse air vacuum system will allow exploration of previously unexplorable locations because as compared to conventional equipment, the apparatus is smaller, more compact, lighter in weight, and more easily transported into areas which were previously too costly to explore.

Drilling with the reverse air vacuum system provides a high velocity air stream to suck the cuttings off the roller bit or drag bits for their cutting edge and thereby the hole is kept cleaner and the drill can be kept on a solid bottom at all times. Also, when fissures, cracks or tunnels are encountered down the hole, it is impossible to lose circulation. The drill bit can drop through tunnels or open space and keep on drilling. When water in excess of that which can be atomized and drawn out using the vacuum system is encountered, it is only necessary to pack off above the water or fissure or crack and force a quick-setting chemical agent into the formation and then clean out the hole and proceed with vacuum drilling. If too much water is encountered, the vacuum attachments are pulled out of the hole, casing is set and a diamond drill bit with standard wire line coring barrel is used until such water-bearing formation is passed and then a casing or fast-setting chemical or casing is placed in the hole to block off the formation that is causing trouble and the vacuum attachments are lowered down the hole, all mud and water sucked out of the hole, and drilling on the reverse air vacuum is resumed.

The apparatus of this invention is a result of 17 years of field research. I have examined every known core drilling machine, and have concluded that apparatus made and operated in accordance with the instant invention is cheaper to operate, per foot of drilled hole, more efficient, faster, safer, more accurate, and does not contribute in any way to the pollution of the atmosphere or contaminate the wall of the hole. Because of the critical shortage of minerals and oil in the world today, and because of the high cost of exploration and development of mining areas, the present invention will be a boon to mankind. Many areas in arid and dry climates such as Arizona, Nevada, desert and mountainous country, and most of Australia, require transporting water for hundreds of miles before conventional hard rock core drilling can be accomplished. With the reverse air vacuum system, hard rock drilling can be accomplished with staggering economic savings. Another adaptation of the present method and apparatus is in drilling in the permafrost on the north slope of Alaska to provide holes for the H-beams that support the pipe sections. The drilling of permafrost with any other method requires saline mud, air which melts the ice, or chemicals that coat the walls of the drill hole, keeping other material such as melting permafrost or cement from adhering to the wall of the hole; consequently, high gas pressure or constant vibration will loosen the H-beams or the conductor pipe. With reverse air vacuum, the walls of the hole are uncontaminated and, by melting the drilled cuttings to form a "soup" and pouring them back into the hole around the conductor pipe or H-beams, it will adhere and become soldi permafrost.

In high velocity reverse air vacuum drilling according to the instant invention, there is near 100% visual sample recovery of all drilled ore bodies with the sample being deposited in clear polyethylene bags or clear plastic tubes, without any loss or contamination of samples as in other systems. It is more accurate than convention air, mud or diamond drilling, less expensive, dust free, faster and much less expensive. The system is so efficient that it is impossible to lose circulation, under the most adverse conditions, in dry formations. Approximately 100 percent of the cuttings is recovered, even in broken, open fissure or cavernous conditions.

Vacuum drilling in the preferred method and apparatus of the present invention is accomplished by reverse circulation of high velocity air on the vacuum suction side. Clear, uncontaminated air is pulled down the annulus between the drill string and the wall of the hole. The air then travels upward at 10,000 fpm or higher, up the inside of the flush I.D. drill string, carrying chips, dust, and all pertinent elements to a separation and collection system wherein the material is automatically accumulated at the cyclonic separators in, for example, polyethylene bags, where a replication of the uncontaminated mineral stratification in granular form can be examined immediately and accurately.

Trouble encountered with forced air drilling is reduced to a minimum by reverse air vacuum drilling. The system's dust-free operation protects drilling personnel and greatly reduces the possibility of their contracting silicosis, pneumoconiosis, phthisis, or other diseases common in the drilling field. Furthermore, it gives equipment longer operational life.

Longer operational life of the bit is accomplished by the reverse air flow of free uncontaminated, above-the-ground-temperature air down the annulus. This keeps the bit 50 to 75% cooler than any other method of air drilling.

Geologists are able to record accurately and scientifically, the stratifications as they are drilled. This is possible because the geologists can see at once the changes in formation as the sample comes into the plastic tubes at the cylonic separators. This process provides, therefore, a continuous visual log of the drilled hole, eliminating the necessity to stop drilling operations for core sampling. If a core sample is desired, in dry formation, a vacuum wire line core barrel is lowered to take such a core.

The apparatus of this invention, with the combination of wire line diamond drill attachment with water or vacuum, driven by a top head drive from 0–1100 rpm, makes it possible to drill to 5,000 feet and beyond. The apparatus has the capacity of regular standard wire line diamond core drilling with water or air assist, or vacuum in dry formations, down-the-hole hammer drilling with exclusive vacuum recovery, and built-in wire line diamond drill to follow up any vacuum drill hole, in order to finish the hole when water is encountered.

Referring to the drawings, the apparatus shown in FIG. 1 includes a truck 10 carrying at the rear a portable drilling tower 11. The tower 11 can be of conventional construction; in the embodiment shown it includes a hydraulic jack 12 which can be operated to fold the tower on the truck for movement to a new location.

The tower supports a hollow drill stem 13, at the lower end of which is a drill bit 14. This bit in the preferred embodiment differs from the conventional tricone bit in the provision of an additional heavy skirting between the rollers as shown at 14*a* in FIG. 7 to assist in the production of a high velocity air stream and the ready pickup of drilled particles adjacent the drill piece and in the provision of an interior opening of equal cross-sectional area with the interior of the drill pipe. The stem is rotated by an elevated Kelly-type drive 15 through which the upper end of the stem extends. The upper end of the stem includes at its upper end a surge chamber 16 to momentarily remove the air velocity to which is connected to hose line 17 which is utilized during reverse vacuum drilling to apply a vacuum to the drill stem.

The source of vacuum for the system is a positive displacement type suction pump or blower means 18 which is mounted on the bed of the truck 10 and which discharges through a muffler 18*a*. The suction side of the blower is connected with an air cleaning system including an oil-bath air filter 19, an air washer unit 20, a final dry collector unit 21 and cylonic separators 22, 23. The manner in which these various components are associated with one another will be subsequently described. All of these units or components are conveniently mounted on the truck bed; and, as will be seen, they cooperate with one another to bring about the desired collection of the drill cuttings and the return to the atmosphere of clean, uncontaminated air.

In the general operation of the system, with the valves set as in FIG. 2, and as has earlier been briefly alluded to, the suction pump or blower means 18 operates to apply the continuous vacuum to the hose line 17 connected with the top of the drill stem. The entrained particles leaving the drill stem are carried first through a valve 24 (See FIG. 2), then to a manifold 25 to one or the other of the cyclone separator sets. The paths to the cyclone separators are under the control of the valves 26, 27 wich are linked by links such as 28 to a common control 29, which may be a bank of hydraulic cylinders or the like. The common control also serves to operate bleeder valves 30, more of which will be said later. These valves are of quick snap acting ball type so that they rapidly and practically instantaneously close and open and provide a flow path equal in area to the flow area of the pipes or conduits; such valves as such for other uses are known to those skilled in the art, and the details of their construction play no part in my invention.

As will be subsequently explained in somewhat greater detail, the cyclonic separators serve as the point of initial collection of drill cuttings. After leaving the cyclone separator sections, the air stream (relieved of the major and most fine particles) is delivered to the final dry collector section 21, where the very fine particles are captured and can be collected. The stream then moves on into the air washing and oil-bath air filter sections 20, 19 respectively, and thence to and out the discharge of the blower.

The air washer comprises a casing 20*a* having an input conduit 43 at one end and an exhaust conduit 32 at the opposite end. A water pump 31 is connected with a source of water (not shown) and delivers it under high pressure to a series of spray atomizing nozzles 33 adjacent the input end. A series of transverse baffles in the form of excelsior packs 20*b* are spaced along the casing. These act to collect any moistened dust carried on past the final dry collector section. The casing 20*a* is provided with a removable cover or wall so that the packs 20*b* can be removed and washed, and the residue collected for analysis.

Figure 6:
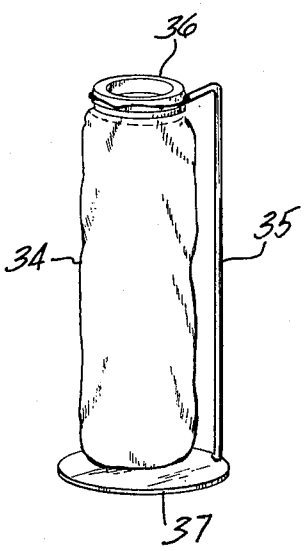
FIG. 6 is a perspective view showing a stand for and a collector bag.

Collection of particles at the cyclone separators is preferably done in transparent bage such as polyethylene bags 34, the general nature of which is illustrated in FIG. 6. The bag is shown in a metal wire holder or stand 35, the open mouth of the bag being secured to a ring on the holder by an internal tapered wedge ring 36 with a bottom plate 37 providing a standard. These bags can be slipped up inside a hollow plastic tube 22*a*, 23*a* located at the lower or discharge end of the cyclone separators, an air tight sliding bottom support plate or trapdoor being used to hold the bags in place within the tubes during collection. However, in many cases collection may be made in the tubes without the use of the bags.

Figure 4:
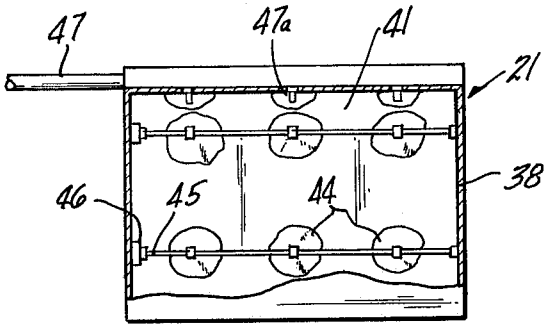
FIG. 4 is a top plan view, on a reduced scale, of the collector unit, parts being broken away for purposes of illustration.
Figure 3:
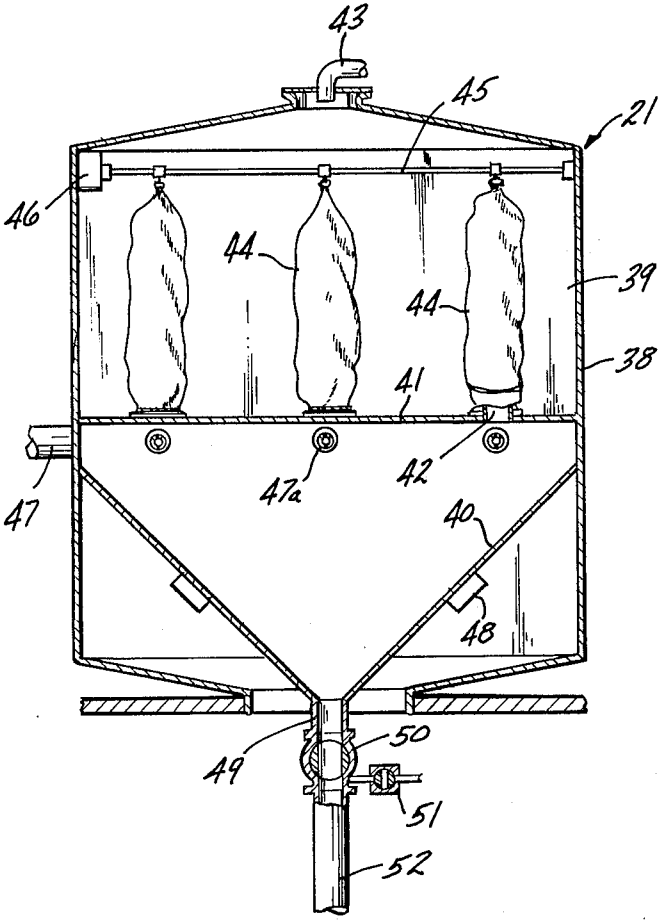
FIG. 3 is a sectional view, on an enlarged scale, of the final dry collector unit showing also a portion of the truck bed on whcih it is carried.

The structure of the final dry collector 21 is generally shown is FIGS. 3 and 4. Basically it comprises an outer housing 38 which is sub-divided into an upper bag compartment 39 and a lower hopper section 40 by a horizontal partition 41. The partition is substantially air tight except for two rows of openings 42 having flanges which project upwardly within the bag chamber. Vacuum is imposed to the bag compartment 39 through the line 43.

Within the bag chamber are mounted two rows of finely woven fabric bags 44. The closed upper ends of these bags are suspended from a rod 45, which is mounted for rapid longitudinal oscillation under the influence of oscillating motor 46, which may be an electric motor. The lower, open, ends of the bags are sleeved over and secured to the flanges at the partition openings. As will be evident, air is drawn through the bags from the chamber below and any particles carried by the air will be intercepted by and deposited on the insides of the bags.

The airstream from the cyclone separators enters the hopper section 40 through the line 47, which comes from the second or smaller of the cyclone separators. As can be seen particularly from FIG. 4, the line 47 runs along the side of the collector and venturi nozzles 47*a* communicate with openings in the line so that the air, as it enters the chamber, is given added velocity to distribute it more uniformly across the chamber.

The hopper has a sloping hopper bottom which preferably is of highly polished interior construction, or alternatively, coated with Teflon, stainless steel or similar material. Agitators in the form of electrically driven vibrators 48 are mounted on the hopper in order to cause gravity movement of material deposited on the hopper walls toward the discharge 49 of the hopper. A ball valve 50 controls discharge. In addition, a bleeder valve 51 is located below valve 50 so that when the latter is closed, the vacuum can be relieved in the spacer below the valve. The space below the valve is occupied by another collector tube 52 which can be fitted in any desired way to the discharge and can be removed therefrom once the valve is closed.

The particles cut in the hole and drawn up through the hollow drill stem 13 range in size from microns to one-half inch and above. Drilling with 10,000 to 30,000 pounds of pressure on the bit, the cuttings consist approximately 99% above the micron size. Tests based on flow through transparent tubes show all cuttings, including fines and the coarse material, traveling in the center of the plastic tube at such velocities that it is almost impossible to detect any separation; an ordinary flour sifter can be utilized to determine the percentages of powder, the size of the cuttings and the condition of the cutters on the bit by sitting a portion of a "grab" sample from one of the large cyclones.

The velocity of air passing up through the drill stem ranges from 5,000 to 15,000 fpm, and the internal diameter of the drill stem may be from less than 1 inch to more than 10 inches. Particles collected at the cyclone separators and dropped into the collector tubes reflect very closely the actual stratification within the hole, since the material is delivered within seconds to the tubes in the same order that it has been cut. We have found that changes in depth are reflected by the changing color.

In a typical example, a 1½ inch drill stem was used with similar diameter hose, and the large cyclones were approximately 6 inches in diameter. This provides a sufficient drop in velocity so that the cuttings will spin out and drop into the collector tubes.

In vacuum drilling in any kind of rock, the drill bit 14 preferably is such that the normal openings between the three legs of the tri-cone are closed up or skirted down as close to the center or below center in order to build up the velocity of the free air entering between the teeth and under the skirt. This is in order to assist in picking up the cuttings as quickly as they are cut and deliver them through the orifice in the drill bit, which is the same inside diameter as the drill pipe inside diameter. The drill bit according to the preferred embodiment is shown in FIG. 7. The body of the bit is the same size as the connector 53, knwon in the drilling art as a double female drill sub. The bit has what is known in the drilling art as a threaded pin 14*a*, as does the drill pipe which has a pin at the lower end. This arrangement insures a high velocity air stream on the vacuum side which moves the particulate drilled material at over 5,000 fpm, depending on the inside diameter of the drill stem. This velocity is maintained up to delivery to the cyclone separators. By utilizing high velocity, and particularly, increasing the velocity in the vicinity of the bit, the drill bit is kept cooler than in high pressure forced air systems or even water. As a result, it is possible to use three cone vacuum roller drill bits or drag bits at much greater depths and for longer periods.

Also, it is possible to use a common vacuum type drill bit (not shown). Inside such a bit there are three air or mud passage holes going directly to each roller bearing. These are provided so that in conventional wet drilling, the rollers will be kept clean of dirt, rock or mud. On the reverse air vacuum, these same passages are used to keep dust out of the bearings, keeping them free to roll and not freeze up. This, in combination with washing the oil out of the bearings before the bit goes into the hole, makes the vacuum bit re-tippable as high as seven times before the bearings go out, with a result in economy to the driller and his client.

The jack means 12 of FIG. 1 may be used to position the drill tower at any conventional angle to drill angled holes. In fact, using high velocity air on the vacuum side, the problems of angle drilling are minimized because the particles are moving at such high relative velocities there is little or no drag or accumulation on the side of the drill stem. Also, conventional means are employed to automatically control the weight of the drill bit on the drilled material to insure optimum cutting. Since the readout of strata material at the cyclone collector tubes is virtually instantaneous, the operator can vary the weight of the drill bit more rapidly to avoid temporary heat buildup.

When drilling through "thief" formations or loose fissure material, using the high velocity vacuum system, there is no loss of circulation. In conventional high pressure air drilling, the huge volume of air required to pressurize the hole "bleeds" the cuttings off into the thief formation, the drill chips are not removed from the drill bit with consequent damage to the drill bit and loss of hole-making capacity, sometimes resulting in stuck drill stem or drill pipe. In the reverse air vacuum system as thus far described, the annulus is not pressurized, and therefore there is no bleed-off into the fissure.

In operation, the apparatus of the present invention permits drilling and recovery of sample material using high velocity air on the vacuum side down to 5,000 feet or beyond. If water is reached having a flow of less then 8 gallons per minute, the high vacuum system will continue to remove the drilled material and merely requires the additional step of removing the water from the drilled material.

If water is encountered while drilling with reverse air vacuum, and it exceeds the lifting capacity of the high velocity air (or from 2 to 8 gallons per minute, depending on the inside diameter of the drill pipe: 1 inch, 2 gallons per minute; 1½ inch, 4 gallons per minute; 2 inch, 5½ gallons per minute; 2½ inch, 8 gallons per minute) the valves 24, 24*a*, 54 and 54*a* are operated to disconnect the vacuum drilling system and switch to other types of drilling procedures which may utilize drilling fluid supplied through line 55 and pump 56. The vacuum system blower can in fact be kept running if desired, drawing outside air through the system through the line 24*b* at valve 24*a*, which is just ahead of the blower 18. It is quite important that valves 24 and 24*a* be operated simultaneously, by direct linking, common control, or otherwise.

A standard wire line coring apparatus (not shown) can be employed after casing has been set to keep the diamond drill pipe from flopping around. After passing through the water table, the hole can be underreamed and casing can be pushed to the bottom of the hole, or chemical can be grouted into the formation and after holding pressure for a given period of time, the pressure is released. If the hole holds pressure, then casing can be removed after all water and mud has been vacuumed out of the hole and the diamond drilling apparatus has been removed and the system can be switched back to the reverse air vacuum system through use of valves 54, 58, 24 and 24*a*.

As earlier mentioned, the drill cuttings can be collected in plastic bags at the cyclone separators 22, 23 and in plastic bags or tubes at the final dry collector 21. The cuttings are deposited essentially in stratified form, reflecting the strata which has been drilled through. The bags, which are removed from the cyclonic separators when filled, can be laid end-to-end to give an replication of the geologic strata being bored. Also, it is possible to correlate the depth from which the sample is taken with the sampled material.

Figure 5:
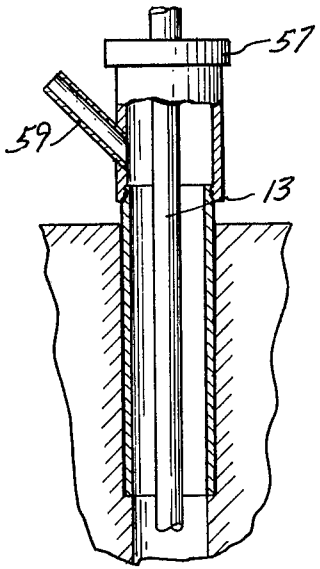
FIG. 5 is a schematic view showing an arrangement at the top of the hole for utilization in applying a reverse vacuum or supplying air to the annulus.

FIG. 5 shows an arrangement wherein the reverse air vacuum system can be employed with a down-the-hole hammer drill bit (not shown). A drill stem seal 57 seals off the annulus of the drilled hole and provides an air tight rotary seal with drill stem 13. Using a down-the-hole hammer, which is well known in the art and forms no part of the present invention, air is forced down the drill stem to operate the cylinder of the hammer. This is effected (refer to FIG. 2) by closing valve 24 and opening valves 54 and 58. The cuttings, chips and particles are removed from the hole by high velocity air caused by applying the vacuum system of FIG. 2 through opening valve 60, which provides a path to a line 59, which connects with the annulus (FIG. 5). When valve 60 is opened, valve 24*a* should be shifted to reconnect the suction side of the blower with the system. As in the previous case, the drilled particles are deposited in the visual receptacles in the cyclonic separators and the final dry collector.

It will be apparent that by using the arrangement of FIG. 5, vacuum drilling fluid or compressed air can selectively be applied to either the annulus or stem, and by the same token, using either the FIG. 1 arrangement or FIG. 5 arrangement, drilling mud or compressed air can be supplied to the drill string with vacuum or no vacuum on the drill string. Thus drilling fluid can be used in the conventional manner of drilling, pumping it down through the stem and up through the annulus by closing valve 24, and opening valves 54 and 54*a*. Valve 61 would remain closed, as would valve 60. A switch can be made from drilling fluid to compressed air by reclosing valve 54 and opening valve 58. Compressed air can be supplied to the annulus in the FIG. 5 arrangement while a vacuum is imposed on the string by opening valves 58 and 61 with valves 60, 54 and 54*a* remaining closed.

Detecting means may be employed within or in the vicinity of the collection of the cuttings to detect various changes occurring within the drilled strata. For instance, galvanometer means may be positioned such that the particulate matter passing thereover would indicate the presence of water. This is of distinct advantage because the high velocity air vacuum drilling could be interrupted by manipulation of the valves heretofore described, and the diamond drill attachments brought into drilling position for drilling the wet strata. Also, from a geochemical standpoint, it is important to know whether or not the Ph of certain of the strata is basic or alkaline and ordinary testing methods may be employed on a continuous basis for this purpose.

When drilling for uranium samples, it is possible when using the present apparatus and method, and because of the dry condition of the samples, to place a Geiger counter or other radiation detecting device near the polyethylene bag or the collection tube and therby constantly monitor the drilling for any indications or uranium. When using conventional diamond drilling for uranium samples, water or drilling mud is employed to cool the bit and carry the drill cuttings and chips to the surface. This tends to dilute and contaminate the sample, and in many cases gives erroneous indications.

The sealing arrangement of FIG. 5 can also be used, as earlier noted, in conjunction with the vacuum arrangement wherein the cuttings are drawn upwardly through the drill stem 13. With the sealing arrangement, air from blower 18 (or from a separate source) can be applied to the annulus in order to assist the vacuum in lifting the material through the drill stem. Also, and as earlier described, it is possible to pull a vacuum on the annulus and remove the cuttings from the bore hole by vacuum with air assist and entrain material up the annulus and out the annulus through the seal to the separator means. While not shown in the drawings, it is envisioned that additional pipes or casing may be placed in the hole to provide for controlled cross sectional area during pulling of vacuum on the annulus.

The recovered material in the plastic tubes may be split by a "Jones" splitter to give the geologist smaller samples for analysis. Also, it is possible to take "grab" samples by quickly changing back and forth from the one set of the cyclonic separators to the other set. The bleeder valves 30 operate to relieve the vacuum in the respective cylonic separators when the valves 26, 27 are closed, thus permitting access to the collection tubes 22*a*, 23*a*.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A method of drilling in wet, dry, or caving formations with near 100% geologic sample recovery in dry formation and taking core samples in wet formation comprising the steps of:

A. forming a continuous bore hole in the earth by drilling with a hollow stem rotary drill;

B. removing the drilled material from the bore hole in dry formation by entraining the drilling material in a current of air rising in the drill stem created by a vacuum applied to the top of the drill stem;

C. guiding the drilled material from the drill stem to a separator and collecting means;

D. separating the drilled material from the air;

E. collecting the drilled material;

F. and, when wet formation or the depth limit of the vacuum is reached, the steps of disconnecting the vacuum from the drill stem;

G. connecting a drilling fluid pump to the hollow drill stem;

H. pumping drilling fluid down the hollow drill stem and removing the drilled material from the bore hole by entraining said material in the drilling fluid as it rises in the annulus formed between the hollow drill stem and the earth formation;

I. and at selected depths in the bore hole the step of taking core samples and raising same to the surface.

2. The method of claim 1 including the further step of pushing a casing down between the earth formation and the drill stem after the wet formation is passed, or sealing off the wet formation with chemical.

3. A method according to claim 2 with the additional steps of disconnecting the drilling fluid pump from the drill stem and removing all fluid by vacuum and connecting the vacuum thereto and removing the drilled material as in steps B through F.

4. A method according to claim 1 and when drilling and removing the drilled material by steps B through F, the additional step of forcing air down the annulus to assist the vacuum in raising the drilled material up through the drill stem.

* * * * *